US005132728A

United States Patent [19]

Suzaki et al.

[11] Patent Number: 5,132,728

[45] Date of Patent: Jul. 21, 1992

[54] DRUM DRIVING UNIT OF ELECTROPHOTOGRAPHY PRINTER

[75] Inventors: Masafumi Suzaki, Hitachi; Tsugio Kikuchi, Ibaraki; Yousuke Nagano, Hitachi; Yoshifumi Homma, Hitachi; Kenichi Ebata, Hitachi, all of Japan

[73] Assignee: Hitachi, Ltd., Tokyo, Japan

[21] Appl. No.: 521,524

[22] Filed: May 10, 1990

[30] Foreign Application Priority Data

May 19, 1989 [JP] Japan ..... 1-124329

[51] Int. Cl.[5] ..... G03G 15/00

[52] U.S. Cl. ..... 355/200; 29/122; 355/211; 403/355

[58] Field of Search ..... 355/200, 210, 211, 212; 403/354, 355, 378, 379; 29/115, 116.1, 122, 123

[56] References Cited

U.S. PATENT DOCUMENTS 2,300,514 11/1942 Lewis ..... 403/354 X 4,425,036 1/1984 Kameyama et al. ..... 355/200

FOREIGN PATENT DOCUMENTS 193931 11/1983 Japan .

96317 4/1988 Japan .

75274 5/1989 Japan .

*Primary Examiner*—R. L. Moses

*Assistant Examiner*—Christopher Horgan

*Attorney, Agent, or Firm*—Antonelli, Terry Stout & Kraus

[57] ABSTRACT

An electrophotography printer includes a drum formed of a non-magnetic cylindrical body having an outer circumferential surface to which a photosensitive material is applied, end brackets attached to opposite ends of the drum, and a drum shaft for transmitting a driving torque to the drum. A connection structure between the drum and the drum shaft includes end bracket shafts provided on the end brackets, a hole formed in the drum shaft so as to be capable of engaging with one of the end bracket shafts, parallel pins provided on the end bracket shafts so as to be perpendicular to the axes thereof, and at least one taper groove formed in an end portion of the drum shaft. When the drum is housed, one of the parallel pins and the taper groove engage with each other while the whole of the drum is pressed toward the drum shaft by an elastic member, thereby reducing the non-uniformity of the rotation of the drum.

1 Claim, 7 Drawing Sheets

DRUM DRIVING UNIT OF ELECTROPHOTOGRAPHY PRINTER

BACKGROUND OF THE INVENTION

This invention relates to an electrophotography printer such as a laser beam printer and, more particularly, to a drum driving unit of this kind of printer.

A drum driving unit of a conventional electrophotography printer will be described below with reference to FIG. 2. An end bracket 2 is attached to an end of a drum 1 constituted by a non-magnetic cylindrical body having an outer circumferential surface to which a photosensitive material is applied. An end bracket shaft 3 is attached to the end bracket 2 coaxially with the same. A spring type one-way clutch 5 is coaxially incorporated in a drum shaft 4 for transmitting a driving torque to the drum 1. The drum 1 is an expendable member and needs to be changed periodically. To change the drum 1, a drum assembly 6 integrally formed the drum 1, the end bracket 2 and the end bracket shaft 3 is changed. The end bracket shaft 3 of a new drum 1 is brought into engagement with the one-way clutch 5. In ordinary electrophotography printers, the drum 1 is rotated in only one direction. The arrangement may therefore be such that the one-way clutch 5 is locked with respect to the direction of rotation of the drum 1 to enable the torque of the drum shaft 4 to be transmitted to the drum assembly 6. At the time of of the exchange, the attachment position of the drum 1 in the rotational direction is not particularly limited, and it is sufficient to establish engagement between the end bracket shaft 3 and the one-way clutch 5 incorporated in the drum shaft 4.

The above-described conventional art entails a problem described below.

FIG. 3 shows the results of an actual test which was conducted in such a manner that an optical encoder was attached to the drum of a conventional type of printer to detect the rotational speed of the drum and, hence, to measure the variation in the rotational speed (unevenness) with respect to a reference speed during one revolution of the drum. In FIG. 3, segments (B) which indicate abnormally large speed variations are clearly seen between segments (A) which indicate speeds in a normal range. Variations in the drum speed are caused by the variation in the force of friction between the drum and a blade cleaner for removing surplus part of the ink applied to the drum, but deteriorations of the image qualities caused by the influence of these variations are small. Therefore the present invention is not intended to remove small speed variations such as those indicated by the segments (A). FIG. 4 schematically shows features of an actual image sample printed on the condition shown in FIG. 3. This actual image sample is called a half tone image formed by drawing lateral lines with small regular pitches to obtain a half tone. Since the recent market trend is being shifted from setting importance on characters to setting importance on graphics, the subject of how to output half tone images having improved qualities is important. In the conventional printers, however, the printing pitches in the direction of rotation of the drum is made uneven due to unevenness of the rotation of the drum 1 (speed variations), resulting in the formation of a light-shade striped pattern, such as that shown in FIG. 4. This phenomenon considerably deteriorates the image qualities. It is therefore very important to prevent this phenomenon.

The reason for the occurrence of such large variations in the rotational speed is that the one-way clutch is repeatedly locked and released irregularly by small vibrations and variations in the load, since the one-way clutch has a restraining force with respect to rotation in only one direction and has no restraining force in the opposite direction.

Japanese Utility Model Unexamined Publication No. 1-75274 discloses a construction in which the entire drum is attached with a pressing force of a spring. However, it is not possible to attain an object of the present invention, i.e., the object of preventing unevenness of the drum rotation and, hence, light-shade unevenness of a half tone by only simply pressing the drum.

Japanese Patent Unexamined Publication No. 58-193931 discloses a method relating to a shaft joint, in which a member constituted by an elastic body having a taper groove is attached to a groove portion of a shaft, and this groove portion is engaged with a spring pin. For driving a laser printer drum, however, it is not suitable to apply the construction in which an elastic member is used for a shaft joint, because the elastic member is elastically deformed with changes in the load to cause vibrations in the axial direction, resulting in light-shade unevenness in the printed image.

SUMMARY OF THE INVENTION

It is therefore an object of the present invention to provide a drum driving unit for use in an electrophotography printer in which a structure including the connection between a drum which is an expendable member and which needs to be changed and a drum shaft for driving torque transmission which must therefore be separated from the drum is optimized to reduce the non-uniformity of drum rotation and, hence, to obtain good graphics while enabling the drum to be changed in a simple manner.

To achieve this object, according to the present invention, a drum driving unit is provided including a hole formed in the drum shaft, with end bracket shafts, being formed on the end brackets so as to be capable of engaging with the hole, and with parallel pins being provided on the end bracket shafts so as to be perpendicular to the axes thereof. A taper groove is formed in an end portion of the drum shaft, and when the drum is housed, one of the parallel pins and the taper groove engage with each other while the entire drum is pressed toward the drum shaft by an elastic member.

According to further features of the present invention, a drum driving unit is provided including a hole formed in at least one of the end brackets, with an engagement shaft portion being formed on the drum shaft so as to be capable of engaging with the hole, and with a parallel pin being provided on the engagement shaft portion perpendicularly to the same. A taper groove is formed in an end portion of the end bracket where the hole is formed, and when the drum is housed, the parallel pin and the taper groove engage with each other while the whole of the drum is pressed toward the drum shaft by an elastic member.

In the construction of the present invention including the hole in the drum shaft and the end bracket shaft provided on the corresponding end bracket, the axes of the drum shaft and the end bracket shaft are aligned with each other and one end of the drum assembly is supported by the drum shaft. The construction including the parallel pins perpendicular to the end bracket shafts and the taper groove formed in the end portion of the drum shaft, in which the parallel pin and the taper groove engage with each other when the drum is housed ensures that a driving torque of the drum shaft is transmitted to the drum assembly. The construction in which the entire drum is pressed toward the drum shaft by an elastic member such as a spring ensures that the parallel pin is pressed against taper surfaces of the taper groove so that the engagement between the drum shaft and the end bracket shaft is free from any play. Consequently, the drum shaft and the drum are connected like an integral member, thereby eliminating the possibility of occurrence of large variations in the rotational speed of the drum (unevenness of rotation). Even if, when the drum is set in the printer, the parallel pin is positioned on the drum shaft end without being engaged with the taper groove, depending upon its position in the direction of rotation of the drum, the pin can be easily brought into engagement with the taper groove as the drum shaft rotates during a warm-up of the printer, because a thrust force based on the force of the elastic member, i.e. spring, is applied to the entire drum.

DESCRIPTION OF THE PREFERRED EMBODIMENTS

Figure 5:
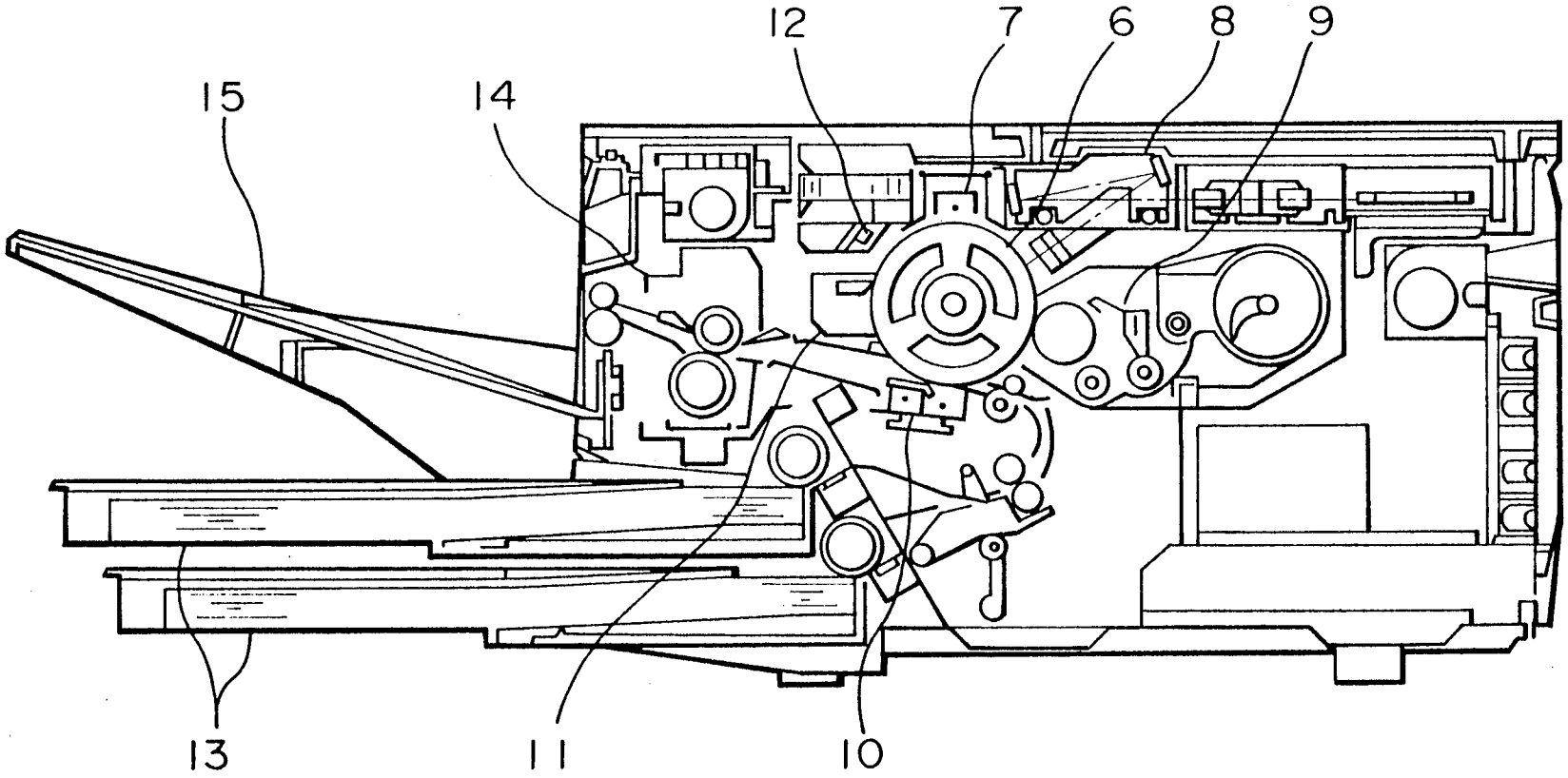
FIG. 5 is a cross-sectional view of the construction of a laser beam printer to which the present invention is applied.

An embodiment of the present invention will be described below with reference to FIGS. 1, 5, and 6. As shown in FIG. 5, a laser beam printer in accordance with the present invention includes an electrifier 7, an optical unit 8, a development device 9, a transfer/discharge device 10, a cleaning unit 11 and an erasing lamp 12 disposed around a drum 6 to which a photosensitive material is applied. These components are arranged to effect an electrophotography process. A printing sheet cassette 13, a fixation unit 14 and a printing sheet discharge tray 15 are also provided.

Figure 6:
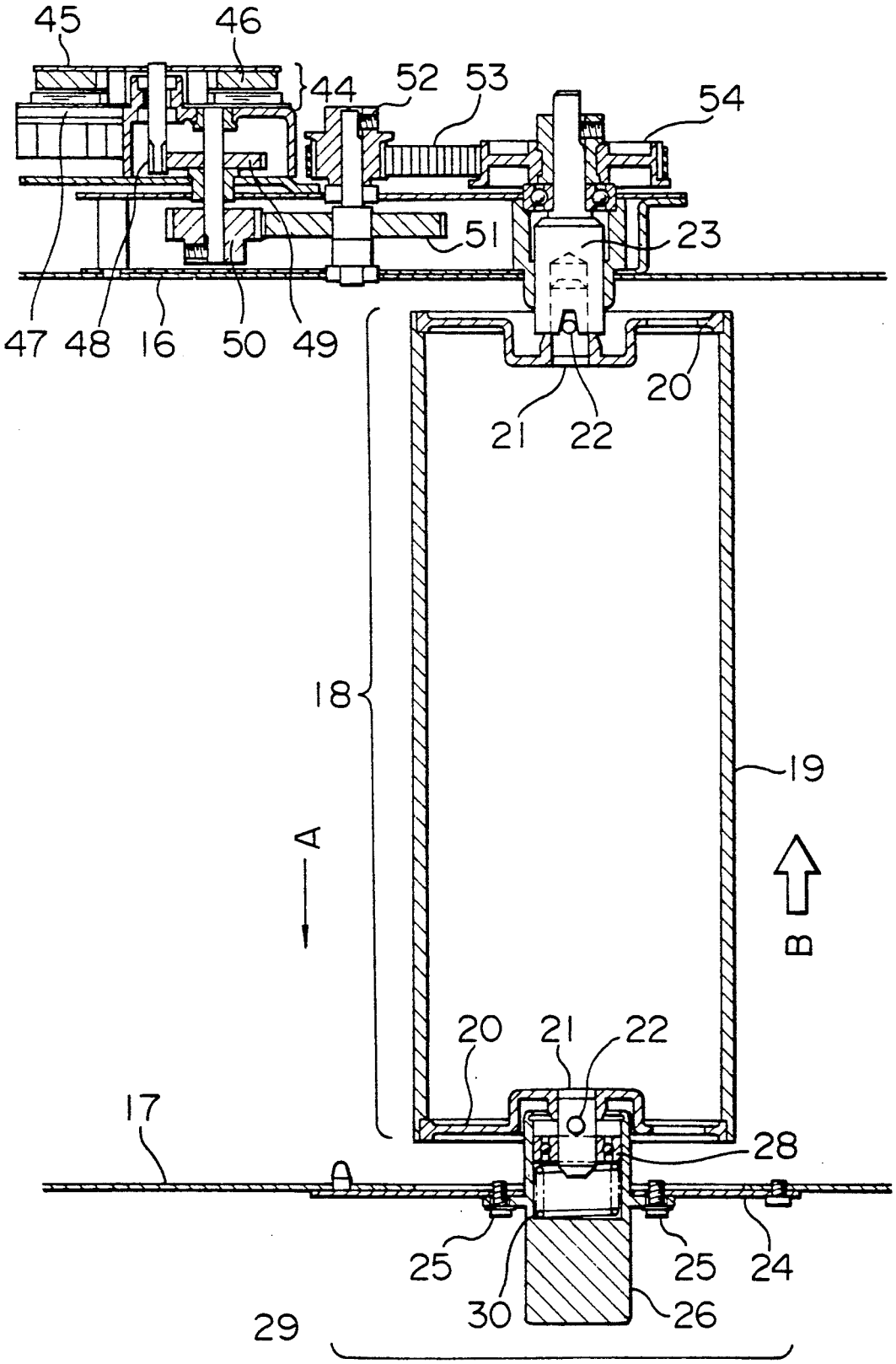
FIG. 6 is a cross-sectional view of a unit for rotating the drum in accordance with the present invention.

As shown in FIG. 6, a drum driving mechanism in accordance with the present invention includes a drum assembly 18 disposed between a pair of body side plates 16 and 17. The drum assembly 18 has a drum 19 in the form of a hollow cylinder formed of a non-magnetic material such as aluminum and having an outer circumferential surface to which a photosensitive material is applied, end brackets 20 respectively fixed by press-fitting to opposite ends of the drum 19, end bracket shafts 21 respectively fixed by press-fitting to the end brackets 20, and parallel pins 22 respectively fitted by press-fitting to the end bracket shafts 21. The drum assembly 18 is symmetrical with respect to a plane transversely bisecting the drum.

One of the end bracket shafts 21 is engaged with and is supported on a drum shaft 23 for transmitting a driving torque to the drum assembly 18 in a manner described more fully hereinbelow with reference to FIG. 1.

The other end bracket shaft 21 is supported on the printer body by a drum support plate assembly 29 consisting of a drum support plate 24, a bracket 26 and a ball bearing 28. The drum support plate 24 is detachably attached to the body side plate 17, the bracket 26 is attached to the drum support plate 24 with screws 25, and the bearing 28 is fitted in the bracket 26 so as to be movable in the axial direction. The drum assembly 18 can be interchanged in such a manner that the entire drum support plate assembly 29 is detached and the drum assembly 18 is thereafter drawn out in the direction of the arrow A.

A cylindrical coil spring 30 is provided in the bracket 26 to constantly urge by the spring force the entire drum assembly 18 in the direction of the arrow B through the ball bearing 28 and the parallel pin 22.

A construction for transmitting the driving torque of the drum driving motor to the drum shaft 23 will be described below.

A driving motor unit 44 has an opposed flat plate type dc motor. A magnet 46 in the form of a disk is mounted on a flat plate 45. The flat plate 45 is rotated by energizing a coil 47 disposed so as to face the magnet 46. The driving torque of this plate is transmitted to the drum shaft through a motor pinion 48 integrally attached to the flat plate 45, a first stage gear 49, a second stage pinion 50, a second stage gear 51, a first pulley 52, a timing belt 53, and a second pulley 54.

Figure 1:
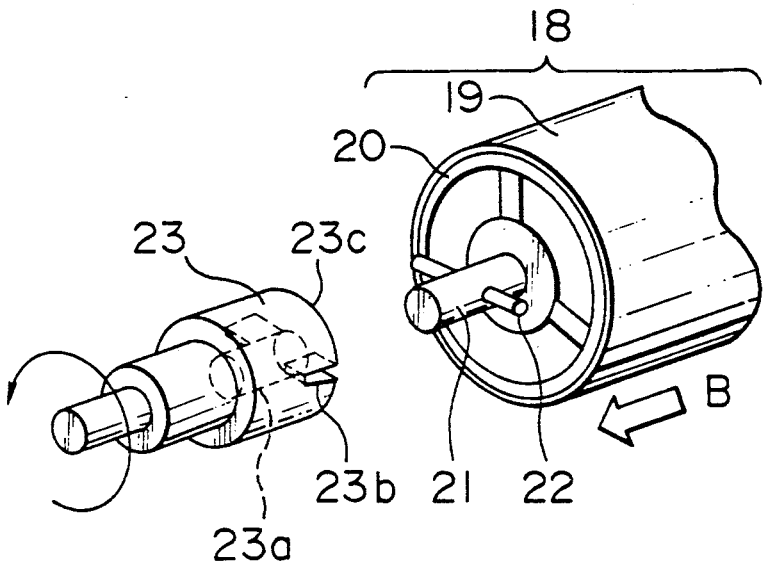
FIG. 1 is a perspective view of drum engagement portions in accordance with an embodiment of the present invention.
Figure 2:
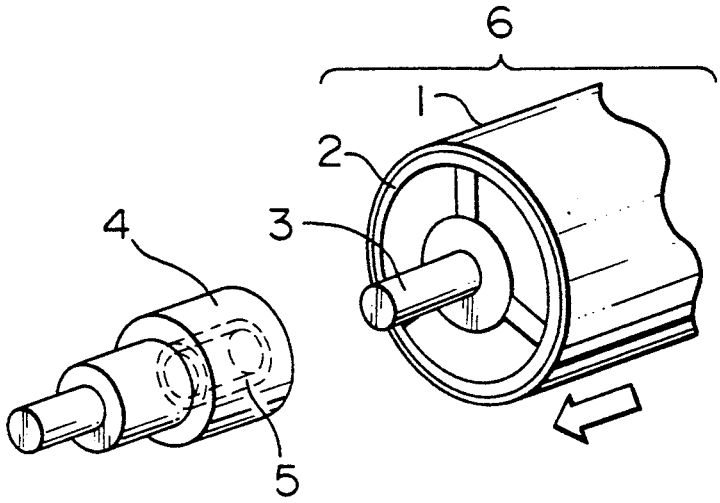
FIG. 2 (PRIOR ART)
FIG. 2 is a perspective view of drum engagement portions of a conventional drum driving unit.

As shown in FIG. 1, the end brackets 20, the end bracket shafts 21 and the parallel pins 22 are integrally attached to the opposite ends of the drum 19 so as to be symmetrical with respect to a plane transversely bisecting the drum 19. The drum shaft 23 has a hole **23*a* in which the end bracket shaft 21 is inserted (fitted). The hole 23*a* is formed with a slight tolerance defined between its diameter and the outside diameter of the end bracket shaft 21 so as to be capable of being fitted around the same without any substantial play in the radial direction at the time of attachment of the drum as well as to be capable of being disengaged from the end bracket shaft. Taper grooves 23*b* are formed in the shaft 23 at an end of the same so as to be capable of receiving the parallel pin 22 when the end bracket shaft 21 is inserted into the hole 23*a*. The groove 23*b* are provided with taper surfaces in order to prevent engagement play between the parallel pin 22 and the grooves and to thereby prevent variations in the rotational speed (unevenness of rotation) of the drum during rotation of the same. That is, since the entire drum 18 is urged in the direction of the arrow B, the outer circumferential surfaces of the parallel pin 22 are brought into engagement with the taper portions of the taper grooves 23*b* without permitting any engagement play. Even if, at the time of setting of the drum 18, the parallel pin 22 does not engage with the taper grooves 23***b* and is positioned on a drum shaft end 23*c*, the cylindrical coil spring 30 is compressed to enable the drum assembly 18 to be housed in the printer. Thereafter, as the drum shaft 23 is rotated during warm-up of the printer (while the drum is stopped at the set position), the parallel pin is moved to the position at which it can be engaged with the grooves, thereby being automatically brought into engagement. Additional taper grooves may be provided so that the grooves are arranged crisscross, and further taper grooves may be provided.

Figure 3:
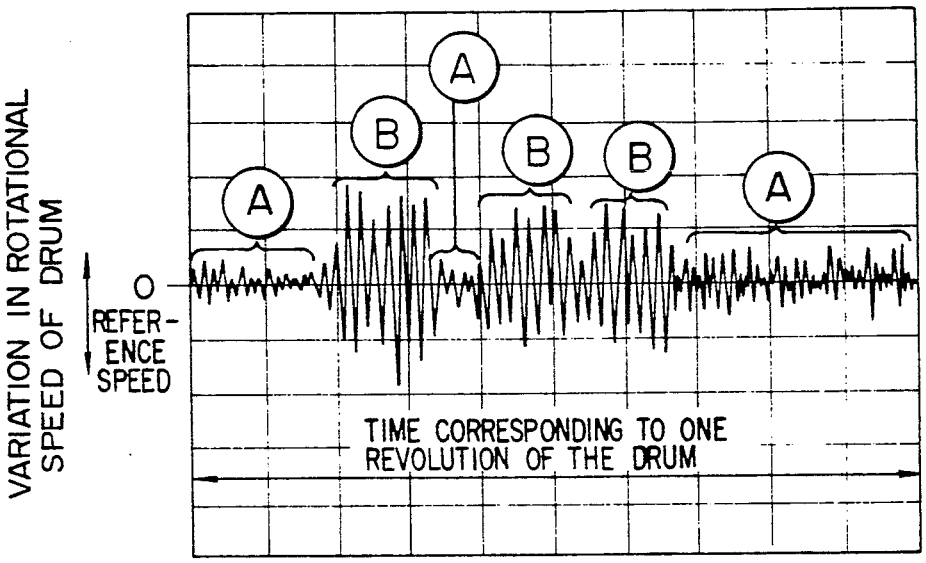
FIG. 3 (PRIOR ART)
FIG. 3 is a graph showing data on the measurement of the variation in the rotational speed of the conventional drum.
Figure 4:
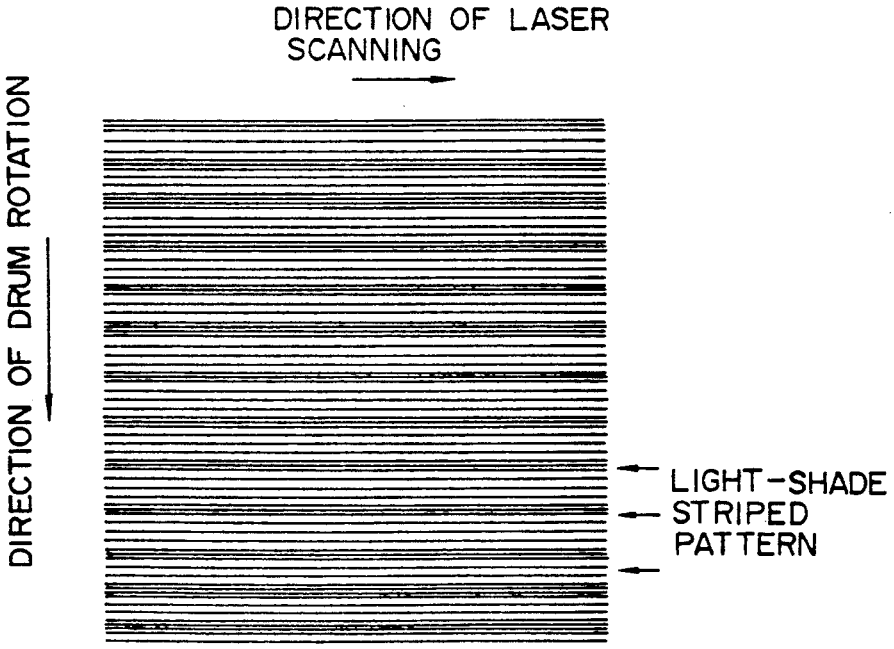
FIG. 4 (PRIOR ART)
FIG. 4 is a schematic diagram of an actual image sample obtained by a printer using the conventional drum driving unit.
Figure 7:
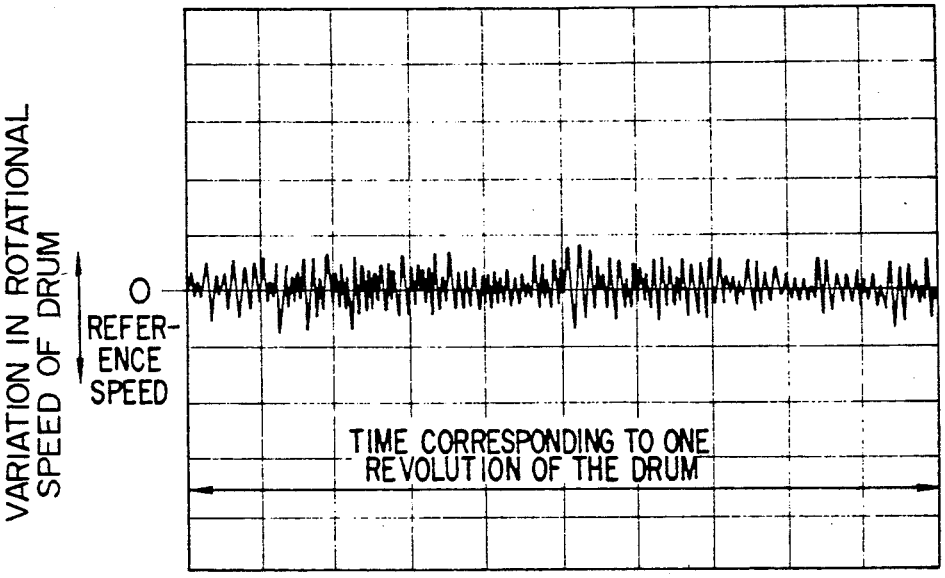
FIG. 7 is a graph showing data on the measurement of the variation in the rotational speed of the drum in accordance with the present invention.

FIG. 7 shows the results of a measurement of the variation in the rotational speed of a printer drum actually constructed in accordance with the present invention. (FIG. 7 corresponds to FIG. 3 showing the speed variation in the conventional arrangement). As is apparent from FIG. 7, the present invention is free from any substantially large irregular speed variations, and the performance is good.

Figure 8:
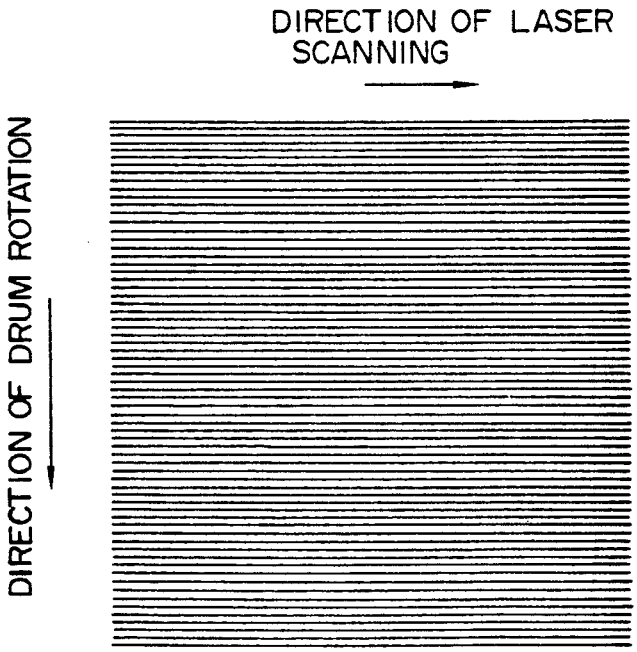
FIG. 8 is a schematic diagram of an actual image sample obtained by the printer using the drum driving unit of the present invention.

FIG. 8 schematically shows the results of printing of a half tone image actually performed by using the printer in accordance with the present invention. As is readily apparent from FIG. 8, no light-shape striped pattern is exhibited and a high-quality image is obtained.

Figure 9:
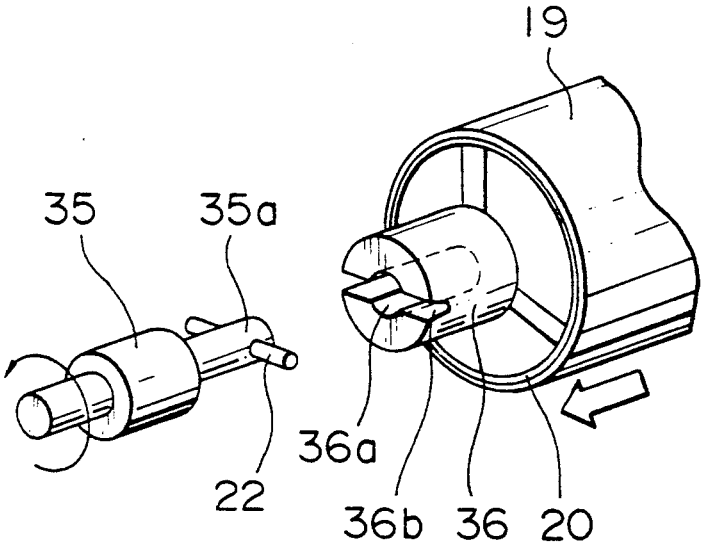
FIG. 9 is a perspective view of an example of a modification of the drum engagement portions in accordance with the present invention.

In the embodiment of FIG. 9, a fitting shaft portion 35*a* is provided on a drum shaft 35, and a parallel pin 22 is press-fitted in the fitting shaft portion 35*a* perpendicularly to the same. An end bracket 20 is press-fitted in the drum 19. A boss 36 is integrally formed on the end bracket 20. The boss portion 36 has a fitting hole 36*a* in which the fitting shaft 35*a* of the drum shaft is fitted, and taper groove portions 36*b*. This arrangement also ensures the same effects described hereinabove in connection with the embodiment of FIGS. 1, 5 and 6.

Figure 10:
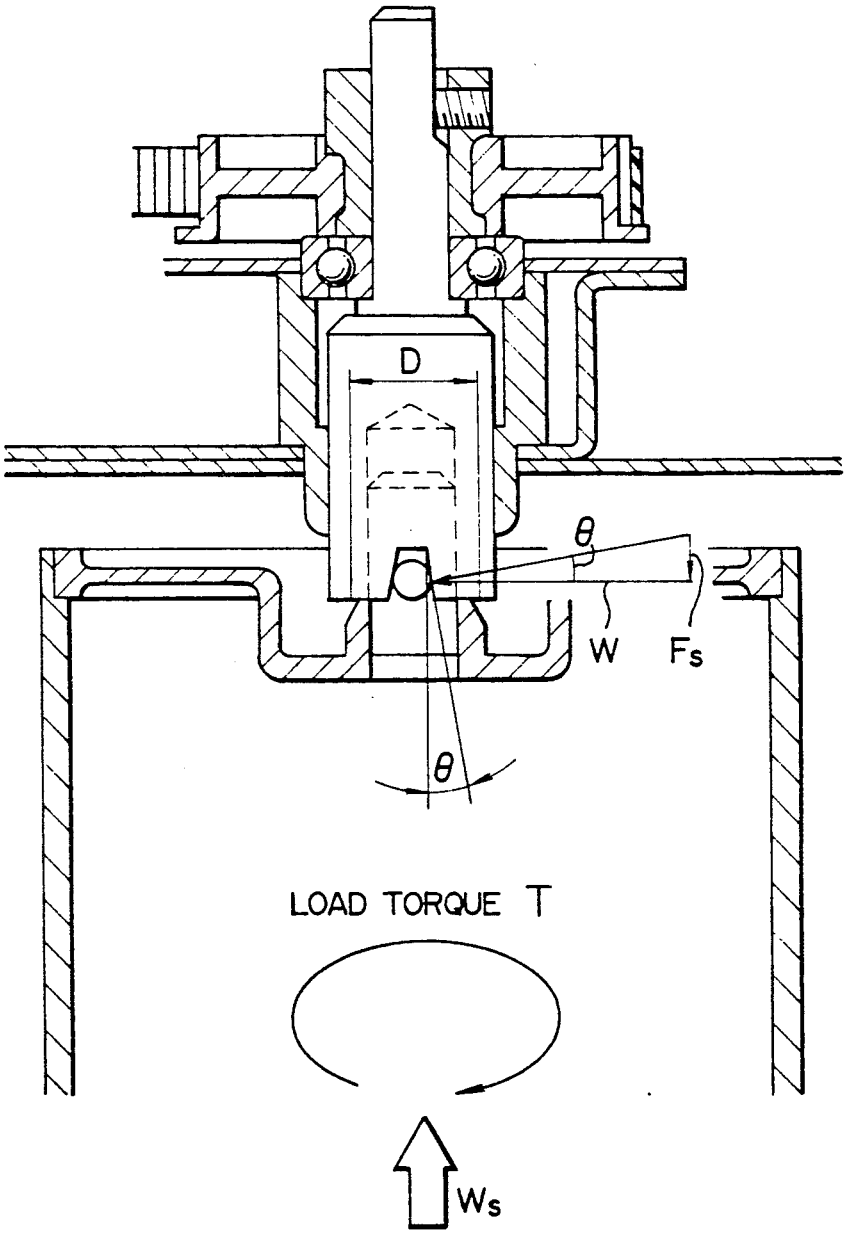
FIG. 10 is a diagram of the setting of the angle of the taper groove portions.

The setting of the angle of the taper grooves will be described below with reference to FIG. 10. If the force of the cylindrical coil spring for urging the drum is $W_s$, $W_s$ must be substantially smaller than an ordinary manual pressing force, i.e., 3 kg or less. Assuming the load torque applied to the drum be T and the average diameter of the drum shaft (the mean of outside and inside diameters) be D as shown in FIG. 10, a force of $W=2T/D$ is applied to the parallel pin in a perpendicular direction.

The parallel pin is engaged with the groove portion having an inclination of an angle $\theta$. A thrust force therefore acts to press the spring backward, which force is expressed by $F_s=W\tan\theta=2T/D\cdot\tan\theta$. $F_s$ must be smaller than $W_s$ in order that the parallel pin is firmly engaged with the taper groove portions. Accordingly, $W_s \geqq 2T/D\cdot\tan\theta$ must be established. In this embodiment, $T=6$ kg-cm, $D=2.2$ cm and $\theta=15°$ are set.

In accordance with the present invention, as described above, the engagement between the drum shaft and the drum is free from any play, and the non-uniformity of the drum rotation is reduced. It is thereby possible to prevent occurrence of light-shade unevenness in half tone images experienced as a problem of electrophotogaphy, thus achieving an improvement in image qualities. The present invention also makes it possible to realize a printer capable of interchanging the drum by a simple operation and thus improved in terms of maintenance facility.

Since the end brackets, the end bracket shafts and parallel pins can be designed for common use in a symmetrical arrangement, the drum assembly can be produced at a high efficiency, and the possibility of occurrence of errors in assembly during production or maintenance operation is reduced, thereby achieving improvements in producibility and assembly facility.

The provision of the parallel pins at the opposite ends of the drum makes it possible to simultaneously realize three functions of transmitting a torque, preventing play and applying a thrust force. It is therefore possible to provide a drum driving unit having a simple construction and improve in performance.

The bearing disposed opposite to the drum shaft can have both functions of supporting the shaft and applying a thrust force, thereby being simplified in structure. Also, the disassembly/assembly performance can be improved while the desired low speed rotation precision is maintained, if the taper groove angle $\theta$ is selected suitably. Since the taper grooves are formed in a rigid body, there is no influence of torsional vibrations in the rotational direction due to changes in the load, which problem is encountered in the case of an elastic grooved member. Stable rotational speed characteristics can therefore be obtained.

What is claimed is:

1. A drum driving unit of an electrophotography printer including a drum formed of a non-magnetic cylindrical body having an outer circumferential surface to which a photosensitive material is applied, end brackets attached to opposite ends of said drum, and a drum shaft for transmitting a driving torque to said drum, said drum driving unit comprising:

end bracket shafts provided on said end brackets;

a hole formed in said drum shaft, said hole being capable of engaging with one of said end bracket shafts;

parallel pins provided on said end bracket shafts so as to be perpendicular to the axes thereof; and at least one tapered groove formed in an end portion of said drum shaft;

wherein when said drum is housed, one of said parallel pins and said taper groove engage with each other while the whole of said drum is pressed toward said drum shaft by an elastic member, and wherein an angle $\theta$ of said taper groove is selected so that if an elasticity force applied to said drum is $W_s$, the driving load torque of said drum is T and the average diameter of said drum shaft is D, $2T/D\cdot\tan\theta < W_s$ can be established, and the elasticity force $W_s$ ranges to at most 3 kg.

* * * * *